United States Patent [19]

Le Chatelier

[11] 4,362,012

[45] Dec. 7, 1982

[54] ANTI-BALLOON DEVICES OF SPINNING FRAMES

[75] Inventor: Jacques Le Chatelier, Riedisheim, France

[73] Assignee: Societe Alsacienne de Constructions Mecaniques de Mulhouse, France

[21] Appl. No.: 179,740

[22] Filed: Aug. 20, 1980

[30] Foreign Application Priority Data

Aug. 24, 1979 [FR] France ..... 79 21330

[51] Int. Cl.[3] ..... D01H 13/04

[52] U.S. Cl. ..... 57/355; 57/119; 57/352; 57/354; 148/6.31; 427/405; 427/438; 428/380; 428/615; 242/157 R

[58] Field of Search ..... 242/157 R; 57/119, 120, 57/352, 354–357; 148/6.31, 6.35, 31.5; 204/49, 52 R; 427/250, 295, 405, 438; 428/380, 457, 615

[56] References Cited

U.S. PATENT DOCUMENTS

| | | | |
|---|---|---|---|
| 2,970,425 | 2/1961 | Foard | 57/119 |
| 3,080,134 | 3/1963 | England et al. | 242/157 R |
| 3,080,135 | 3/1963 | Steijn | 242/157 R |
| 3,084,501 | 4/1963 | Kluttz | 57/120 |
| 3,226,924 | 1/1966 | Dalpiaz | 57/119 |
| 3,316,703 | 5/1967 | McKelvie | 57/354 |
| 3,343,362 | 9/1967 | Lunsford | 57/119 |
| 3,381,464 | 5/1968 | Furst | 57/119 |
| 3,416,301 | 12/1968 | Chilpan | 57/119 |
| 3,787,229 | 1/1974 | Rudness | 242/157 R X |
| 3,959,557 | 5/1976 | Berry | 57/352 X |

*Primary Examiner*—John Petrakes

*Attorney, Agent, or Firm*—George H. Gerstman

[57] ABSTRACT

In a spinning or twisting machine, a anti-balloon ring stationarily fixed around the bobbin spindle is first sand-blasted so as to produce a predetermined degree of surface roughness, then provided with a nickel coating in order to reduce undesirable excrescences followed by a copper coating in order to reduce friction and loss of yarn resistance while permitting much higher spindle speeds in respect of an acceptable rate of wear.

2 Claims, 2 Drawing Figures

ANTI-BALLOON DEVICES OF SPINNING FRAMES

This invention relates to the textile industry and is more particularly directed to an improvment in devices known as balloon reducers or "anti-balloon" devices in spinning frames and especially frames of the revolving ring type.

Figure 1:
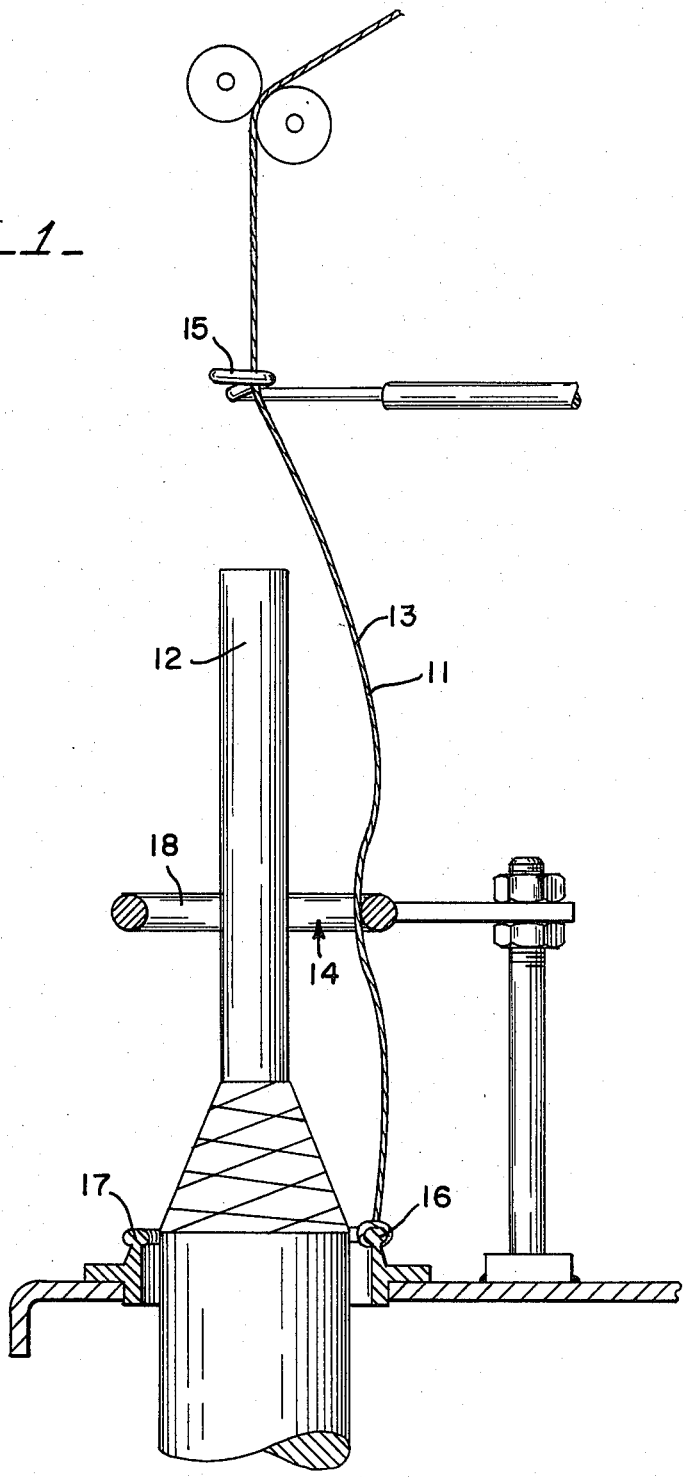
FIG. 1 is a fragmentary elevational view, taken partly in section, of a spinning frame having an anti-balloon device in accordance with this invention.

It is well known that the yarn 11 which rotates around the spindle 12 assumes a shape designated as a "balloon" 13 above a sufficient speed and that the curvature of the balloon increases with the speed of rotation of the spindle. In order to attain higher speeds while limiting the amplitude of the balloon, it is a common practice to provide a device for containing the surface of revolution described by the yarn. This "anti-balloon" device is usually constituted by a stationary ring 14 which surrounds the spindle, the yarn delivered by the yarn guide 15 being applied against the internal surface of said stationary ring before passing into the traveler 16 of the spinning ring 17.

A number of improvements, especially in the field of revolving spinning rings, now make it possible to attain speeds above 15,000 rpm. In this case, however, the tangential velocity of the balloon exceeds 40 m/s, thus causing considerable friction of the yarn on the anti-balloon ring. The friction energy appears in the form of heat, thus subjecting the yarn to a local heat buildup which is sufficient to cause degradation and sometimes even melting of the yarn in the case of synthetic fibers. Moreover, the friction of the yarn on the anti-balloon ring reduces the resistance of the yarn and modifies its appearance such as, for example, the shade of color in the case of a dyed yarn.

French patent application No. 79 05700 filed on Mar. 6, 1979 (U.S. Pat. No. 2,450,888) proposes a solution which reduces the friction of the yarn on the anti-balloon ring. In accordance with this patent application, the stationary ring is replaced by a ring rotatably mounted on a pneumatic fluid bearing. In this case the ring is driven in rotation by the yarn, thus reducing the speed at which this latter is applied in frictional contact with the internal surface of the ring. In one embodiment, a judiciously directed jet of air drives the ring positively at a speed which is close to that of the spindle. Thus, frictional contact of the yarn on the anti-balloon ring is practically reduced to zero.

The improvement which forms the subject of the patent application cited earlier makes it possible to increase the speed of rotation of spinning-frame spindles without causing any damage to the yarn but can be carried into effect only by means of relatively complicated equipment: thrust-bearing attached to the frame of the machine in order to support the anti-balloon ring when this latter is at rest, compressed-air distribution, and so forth, thereby having the effect of complicating the assembly of the spinning frame and increasing the cost price of this latter to an appreciable degree.

The present invention overcomes the disadvantages by permitting an increase in the speed of rotation of the spinning-frame spindles without causing any damage to the yarn while making use of a stationary anti-balloon ring. The invention consists in defining a state of surface 18 such that the friction force is of sufficiently low value to avoid any danger of local heat buildup which would be liable to damage the yarn without producing any prohibitive modifications either in regard to the mechanical strength or in regard to the appearance of the yarn. In addition to its anti-friction qualities, the surface 18 of the anti-balloon ring must have good heat conductivity and sufficient mechanical strength to afford resistance to the phenomenon designated as a "knife-cut" by those versed in the art; sometimes, the yarn is accidentally wound around the ring, in which case the turns are cut with a knife in order to remove the yarn. Thus it may happen that the blade reaches the surface of the ring and causes damage to this latter in the event of insufficient surface hardness.

Figure 2:
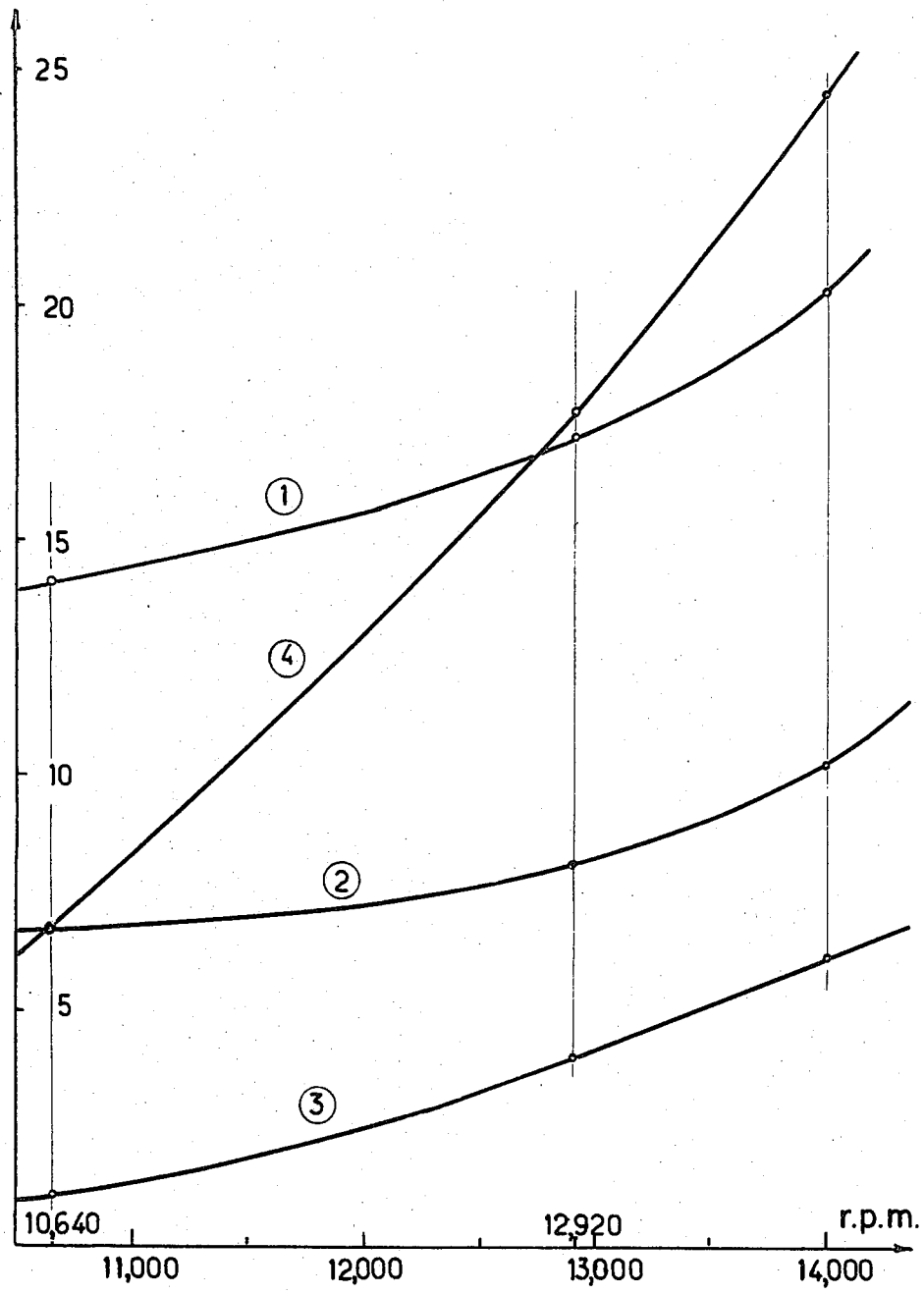
FIG. 2 is a graph which shows in the case of different types of anti-balloon rings the loss of yarn resistance expressed as a percentage and as a function of the spindle speed.

FIG. 2 depicts a graph which shows in the case of different types of anti-balloon rings the loss of yarn resistance expressed as a percentage on the vertical axis and as a function of the spindle speed, recorded on the horizontal axis. This figure illustrates the favorable results obtained by means of the invention and shows the importance of two factors:

(1) the surface roughness of the ring.

(2) the nature of said surface.

Curve 1 relates to a conventional anti-balloon ring or in other words to a steel ring coated with bright chromium plate.

It is apparent from the figure that the loss of yarn resistance would easily attain 25% if and when the spindle were to rotate at 15,000 rpm since the ratio rises more and more rapidly as the speed of rotation increases. It has proved that this considerable degree of friction arises from high values of surface tension between the yarn and the very smooth surface of the ring. The yarn literally "sticks" to the ring.

Whereas it had always been considered in the past that the anti-balloon ring had to be as smooth as possible, it has occurred to the present Applicant that, on the contrary, the surface 18 on which the yarn is applied could advantageously be provided with a certain degree of roughness. Thus, curves 2 and 4 relate to treatments which are intended to increase the surface roughness of the ring. Curve 4 represents the loss caused by a rough-surface ring which has been subjected to coarse sand-blasting followed by deposition of nickel in order to reduce all surface irregularities and excrescences which would be liable to catch onto the elementary yarn fibers. At moderate speeds, the loss is lower than in the case of curve 1, but at high speeds, the result is even worse than in the case of the smooth ring.

Curve 2 relates to a fine sand-blasting operation which is also followed by nickel plating and produces much more satisfactory results. This same treatment followed by a deposition of copper produces a considerable improvement in the relative value of loss of yarn resistance in respect of a given speed of rotation of the spindle (ratio of 3 to 5 to 14,000 rpm). This result is represented on curve 3. Even if the slope of curve 3 is substantially the same as that of curve 2 in the high-speed range, this curve makes it possible to attain a much higher speed in respect of a given permissible rate of wear.

Other coating processes have been attempted but have not proved entirely satisfactory. Tin-plating, for example, not only affords a low degree of mechanical strength but is also unsatisfactory from a friction standpoint.

Cadmium-plating has been ruled out by reason of the difficulty involved on the grounds of contamination and protection of personnel.

Boriding has the effect of forming a delicate coating which comes off in flakes.

The material sold under the trademark Teflon is highly effective from the anti-friction standpoint but is lacking in strength and is subject to rapid degradation.

Ceramics and especially titanium-base ceramics have also proved to be delicate.

On the contary, the invention makes it possible to obtain by means of a suitable surface treatment a stationary anti-balloon ring which permits an increase in the speed of rotation of the spindles of a spinning frame without any potential danger of prohibitive damage to the yarn.

The preferred embodiment of the invention consists of fine sand-blasting followed by nickel-plating and then by copper-plating either by electrolytic or chemical process.

It need hardly be added that these results are not limited to spinning frames but are equally applicable in the case of twisting machines.

Furthermore, when this improved design of anti-balloon ring is employed and the permissible limit of wear is finally attained, it will be possible to carry the method one step further by applying the same treatment to the revolving ring mounted on a pneumatic bearing as described in the French patent application cited earlier.

What is claimed is:

1. An anti-balloon device for a spinning or twisting machine comprising a ring adapted to be positioned around the bobbin spindle of the machine for controlling ballooning of textile strands, said ring having a roughened surface created by a fine sand-blasting operation, said roughened surface being covered with a first metallic coating for reducing the rough excrescences without removal thereof of the roughened surface produced by the operation of said fine sand-blasting and said surface further being covered with a second metallic coating having enhanced heat conductivity properties.

2. The anti-balloon ring of claim 1 in which the first metallic coating is nickel and the second metallic coating is copper.

* * * * *